United States Patent [19]

Hagihara et al.

[11] Patent Number: 4,876,778

[45] Date of Patent: Oct. 31, 1989

[54] METHOD OF MANUFACTURING A MOTORCYCLE RADIATOR

[75] Inventors: Hisao Hagihara; Takayuki Banno; Shigenori Miya; Norio Tanaka, all of Yokaichishi, Japan

[73] Assignee: Toyo Radiator Co., Ltd., Tokyo, Japan

[21] Appl. No.: 168,769

[22] Filed: Mar. 15, 1988

[30] Foreign Application Priority Data

Mar. 30, 1987 [JP] Japan ..... 62-47883[U]

[51] Int. Cl.[4] ..... B21D 53/02

[52] U.S. Cl. ..... 29/157.3 A; 29/157.3 B; 29/428

[58] Field of Search ..... 29/157.3 A, 157.3 B, 29/428; 72/379

[56] References Cited

U.S. PATENT DOCUMENTS

| | | | |
|---|---|---|---|
| 4,380,573 | 4/1983 | Näslund | 72/379 |
| 4,443,921 | 4/1984 | Allemandou | 29/157.3 B |
| 4,516,630 | 5/1985 | Yamaguchi | 180/229 X |

FOREIGN PATENT DOCUMENTS

| | | | |
|---|---|---|---|
| 0106603 | 8/1980 | Japan | 72/379 |
| 5958631 | 10/1982 | Japan . | |
| 59182629 | 12/1982 | Japan . | |
| 0084842 | 4/1987 | Japan | 29/157.3 A |
| 82/03574 | 10/1982 | PCT Int'l Appl. | 72/379 |
| 0375434 | 6/1932 | United Kingdom | 72/379 |

*Primary Examiner*—Timothy V. Eley
*Assistant Examiner*—Frances Chin
*Attorney, Agent, or Firm*—Sughrue, Mion, Zinn, Macpeak and Seas

[57] ABSTRACT

A method of manufacturing a motorcycle radiator comprising the steps of:

(1) arranging between a pair of horizontally arranged water tanks or headers, a straight radiator core comprising in combination: a plurality of corrugated sheets spaced alternately with a plurality of flattened tubes; the flattened tubes; and elongated reinforcing plates, each of said reinforcing plates being provided with a plurality of slits extending from opposite edge portions in width directions of the reinforcing plates, the slits on one of the opposite longitudinal edge portions being disposed in a row and at a predetermined pitch, and the slits on the other of the opposite longitudinal edge portions being disposed in another row and at the predetermined pitch at respective positions halfway between positions of adjacent ones of the slits on the one of the edge portions with respect to a direction parallel to the longitudinal axis;

(11) assembling and brazing these main components to produce a straight radiator which establishes the integrity in its construction; and (111) bending the straight radiator in a direction perpendicular to a longitudinal direction of the flattened tubes so as to produce an arc-shaped radiator.

12 Claims, 5 Drawing Sheets

METHOD OF MANUFACTURING A MOTORCYCLE RADIATOR

BACKGROUND OF THE INVENTION

1. Field of the Invention

The present invention relates to a method of manufacturing a motorcycle radiator for cooling a motorcycle engine by means of cooling water, and more particularly to a method of manufacturing the motorcycle radiator having a arc-shaped radiator core.

2. Description of the Prior Art

In the water-cooled motorcycle engine, the cooling water heated by the engine is transferred to the radiator in which heat exchange is conducted between the thus heated cooling water and open air. In the motorcycle, due to a restricted size of its body, the radiator to be mounted on such body is also restricted in size, particularly, in width. Therefore, much effort has been directed toward the manufacturing of the motorcycle radiator having a small width.

In one of conventional methods for reducing the width of the motorcycle radiator, for example such as methods disclosed in Japanese Utility Model Laid-Open Nos. 59-58631 and 59-182629, the motorcycle radiator is constructed of components comprising a radiator core having been horizontally bent to have an arc-shaped form.

However, such conventional method for manufacturing the motorcycle radiator having a small width is disadvantageous in that it involves lots of cumbersome assembling work causing the manufacturing cost of the radiator to increase.

More particularly, in the conventional method for manufacturing the motorcycle radiator, any of water tubes and air fins of the radiator has an arc-shaped form. Namely, the water tubes are constructed of flattened tube having an arc-shaped form, while the air fins are constructed of corrugated sheets also having an arc-shaped form. As is well known, the water tubes are spaced alternately with the air fins and assembled therewith to form a so-called radiator core which is so sandwiched between a pair of water tanks that the water tubes communicates with these water tanks. The thus assembled radiator also having an arc-shaped form is reinforced with metallic reinforcing plates having an arc-shaped form.

Consequently, in the conventional method for manufacturing the motorcycle radiator, it is necessary to prepare a large number of arc-shaped components such as the water tubes, air fins and the reinforcing plates. In mass production of the motorcycle radiator excellent in quality, it is necessary to produce a large number of these components in uniform and closer tolerance. Consequently, the conventional method involves intricate techniques for manufacturing the radiator, particularly in assembling of the above large number of the arc-shaped components, thus taking much time and labor leading to a considerably high manufacturing cost of the radiator. This is a problem inherent in the conventional method.

SUMMARY OF THE INVENTION

It is an object of the present invention to resolve the above problem inherent in the conventional method for manufacturing the motorcycle radiator.

It is another object of the present invention to provide a method for manufacturing efficiently and at a low cost a motorcycle radiator provided with an arc-shaped radiator core.

It is further another object of the present invention to a method for manufacturing the motorcycle radiator provided with a bracket through which the radiator can be easily mounted on a motorcycle body.

It is still further another object of the present invention to provide the motorcycle radiator produced through the above method of the present invention.

The objects of the present invention are accomplished by providing:

A method of manufacturing a motorcycle radiator comprising the steps of:

(b 1) preparing, (a) a straight radiator core constructed of a plurality of corrugated sheets spaced alternately with a plurality of flattened tubes, the corrugated sheets constituting air fins for heat-exchange use, and the flattened tube constituting water tubes through which cooling water passes, (b) a pair of elongated water tanks or headers having a plurality of holes and disposed in positions horizontally adjacent to opposite end openings of the flattened tubes so as to communicate with said flattened tubes through the holes and the openings, (c) a pair of metallic reinforcing plates having an elongated straight shape, between which the straight radiator core is sandwiched, each of the reinforcing plates being provided with a plurality of slits at its opposite longitudinal edge portions, each of the slits extending in a direction perpendicular to a longitudinal axis of each of the reinforcing plates; the slits on one of said opposite longitudinal edge portions being disposed in a row and at a predetermined pitch, and the slits on the other of the opposite longitudinal edge portions being disposed in another row and at the predetermined pitch at respective positions halfway between positions of adjacent ones of the slits on the one of the edge portions with respect to a direction parallel to the longitudinal axis;

(11) brazing, joints between the corrugated sheets and the flattened tubes, and joints between the corrugated sheets and the reinforcing plates, so that these components are fixedly assembled to form a straight radiator assembly whereby the opposite end openings of the flattened tubes join with the water tanks or headers in a watertight manner; and (111) bending the straight radiator assembly by a predetermined amount in a plane parallel to the longitudinal axis of the reinforcing plate.

In the above method of the present invention, in case that the headers are employed, it is necessary that water tanks are mounted on the headers after completion of the bending operation of the straight radiator assembly.

Additional objects and features of the present invention will become apparent form the detailed description of preferred embodiments of the present invention, which will be made with reference to the accompanying drawings.

DESCRIPTION OF THE PREFERRED EMBODIMENTS

Figure 1:
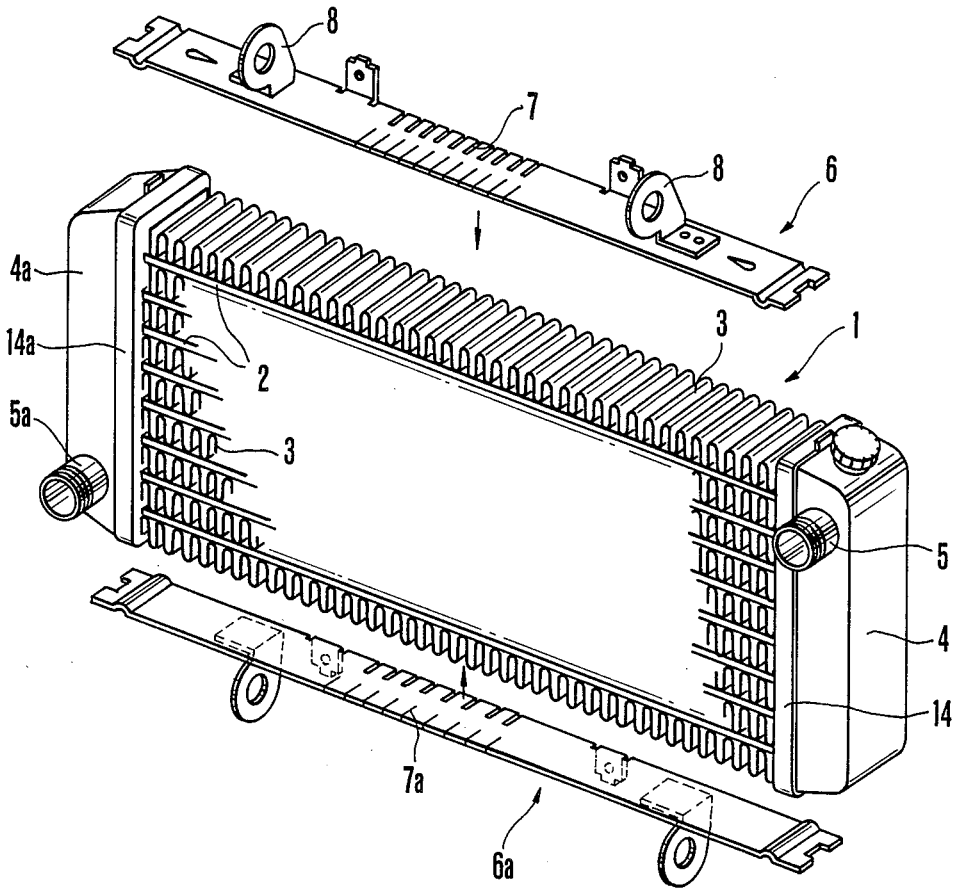
FIG. 1 is a perspective view of components of an embodiment of the motorcycle radiator, which are still not assembled and not subjected to the bending operation according to the method of the present invention.

FIG. 1 shows essential components of a radiator of the present invention produced according to the present invention. As shown in FIG. 1, a straight radiator core 1 is constructed of a plurality of straight flattened tubes 2 which are spaced alternately with a plurality of corrugated sheets 3 so as to be sandwiched between the corrugated sheets 3. The flattened tubes 2 constitute water tubes of the radiator core 1. The corrugated sheets 3 constitute air fins of the radiator core 1.

Since both of the flattened tubes 2 and the corrugated sheets 3 are subjected to a bending operation after they are brazed to each other as will be described later, it is preferable to make them of easily bendable metallic materials, such as copper, copper alloys, aluminum, aluminum alloys and the like. With the use of such easily bendable metallic materials, both the flattened tubes 2 and the corrugated sheets 3 can be subjected to bending without causing any buckling or cracking, provided that both the flattened tubes 2 and the corrugated sheets are adequately designed in thickness, shape and size relative to their bending angles "$\alpha$" which are identical with angles of slopes of the arc-shaped radiator 9 having been subjected to the bending operation as is clear from FIG. 3. Since anyone skilled in the art well knows adequate designs for preventing such buckling and cracking problems, the detailed description of such adequate designs will be omitted.

Figure 4:
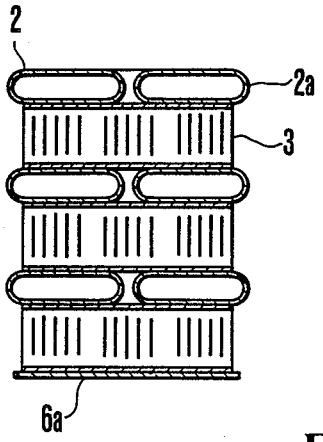
FIG. 4 is a cross-sectional view of the embodiment of the radiator of the present invention, taken along the line IV—IV of FIG. 3.

As shown in FIG. 4 and as is well known in the art, the water tube or flattened tube 2 of the radiator has, in its cross section, an oval shape having a major axis and a minor axis. The flattened tube 2 is sandwiched between the corrugated sheets 3, and its number and arrangement may be changed as needs require. For example, in the embodiment of the present invention shown in FIG. 4, a pair of the flattened tubes 2, 2a arranged in parallel to each other constitute a couple sandwiched between the corrugated sheets 3 so that a plurality of such couples are spaced alternately with a plurality of the corrugated sheets 3. The opposite sides of the flattened tubes 2, 2a, which sides are perpendicular to minor axes of the oval-shaped cross sections of the tubes 2, 2a, are fixed to the corrugated sheets 3 by brazing.

It is also possible to dispose only one or as many as three or even more than three flattened tubes 2, 2a between the corrugated sheets 3.

Figure 5:
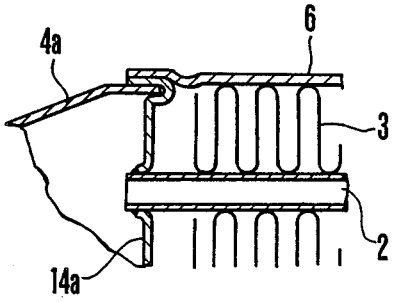
FIG. 5 is a longitudinal sectional view of the embodiment of the radiator of the present invention, taken along the line V—V of FIG. 3.

Opposite ends of each of the flattened tubes 2, 2a communicate with a pair of water tanks 4, 4a of the radiator 9. Each of these water tanks 4, 4a is constructed of a box-shaped tank body having an opening and a header 14, 14a for closing the opening of the tank body. Each of the headers 14, 14a is provided with a plurality of holes to which the flattened tubes 2, 2a are fixedly connected at their opposite ends, respectively. As shown in FIG. 5, edge portion of the opening of the tank body of the water tank 4, 4a is inserted into a shallow annular groove formed in a peripheral portion of the header 14, 14a and fixed thereto by brazing. When this brazing is conducted, the opposite ends of the flattened tubes 2, 2a are also brazed to the holes of the headers 14, 14a. One of the water tanks 4, 4a constitutes a water-input tank, while the other constitutes a water-outlet tank. These tanks 4, 4a are provided with hose-connecting portions 5, 5a through which hoses for transferring a cooling water are connected to the water tanks 4, 4a of the radiator.

As shown in FIG. 1, in assembling of the components of the radiator core 1, the plurality of the flattened tubes 2 are spaced alternately with the corrugated tubes 3 while inserted at their opposite ends into the holes of the headers 14, 14a, so that the radiator core 1 is formed. Then, a pair of metallic reinforcing plates 6, 6a, which have elongated and straight shapes, are disposed outside the radiator core 1 in positions adjacent to the outermost corrugated sheets 3 as shown in FIG. 1.

Each of the reinforcing plates 6, 6a is provided with a plurality of slits 7, 7a which extend from opposite edges of the reinforcing plates 6, 6a in a direction perpendicular to a longitudinal direction of the reinforcing plates 6, 6a. A pair of brackets 8 are fixed to the reinforcing plates 6, 6a in the vicinities of opposite ends of the plates 6, 6a by suitable fastening means such as screws, swaging, welding and the like. The brackets 8 serve as means for fixing the radiator 9 to the motorcycle body. The brackets 8 are so mounted on the straight radiator core 1 that the brackets 8 are aligned with corresponding support members of the motorcycle body after completion of the bending operation of the straight radiator core 1.

The components of the radiator core 1 are assembled and brazed to form the straight radiator core 1, while held at their assembled positions by means of suitable holding jigs. For performing brazing, at least one of the components to be brazed to each other is generally clad in brazing material.

The thus assembled components of the straight radiator core 1 are inserted into a furnace and heated to high temperatures therein, so that the brazing material is melt on the components. The molten brazing material spreads over the joint of the components by capillary action, and is then solidified in the joint so that the components are jointed in integrated relation to achieve the straight radiator core 1. More particularly, as shown in FIG. 1, the flattened tubes 2, corrugated sheets 3 and the reinforcing plates 6, 6a are jointed in integrated side-by-side relation by brazing so as to form the straight radiator core 1. After completion of the above brazing operation of the components of the radiator core 1, the corrugated sheets 3 are selectively fixed to the corresponding components at opposite top and bottom portions of their corrugations by brazing.

The opposite ends of the flattened tubes 2 are fixed to the holes of the headers 14, 14a of the water tanks 4, 4a in a watertight manner by brazing. In FIG. 1, the above-mentioned holes of the headers 14, 14a are provided in vertical inward planes of the headers 14, 14a, and, therefore are not shown in FIG. 1.

The brazed straight radiator core 1 is then subjected to a bending operation according to the method of the present invention. Such bending operation of the straight radiator core 1 is conducted in a manner shown in FIG. 2, so that the straight radiator core 1 is bent by a predetermined amount to create an arc-shaped form as shown in FIG. 3.

Figure 2:
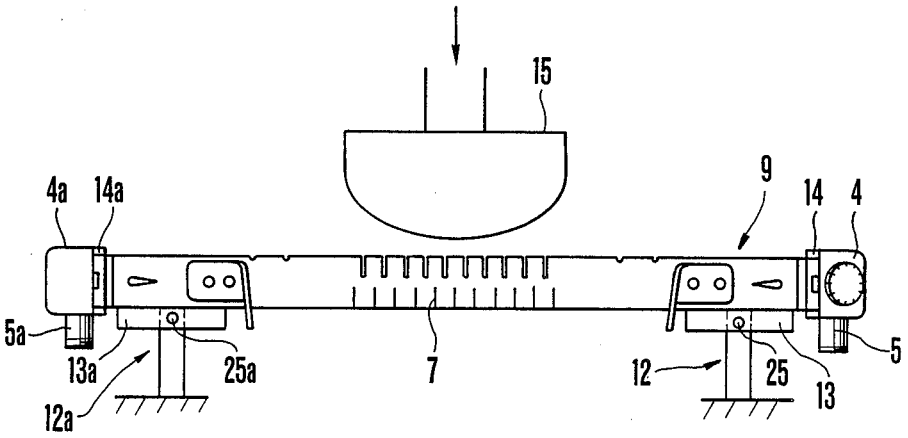
FIG. 2 is a plan view of the embodiment of the motorcycle radiator constructed of the components shown in FIG. 1, illustrating a step of the bending operation of the present invention, which is conducted after assembling the components of the motorcycle radiator.
Figure 3:
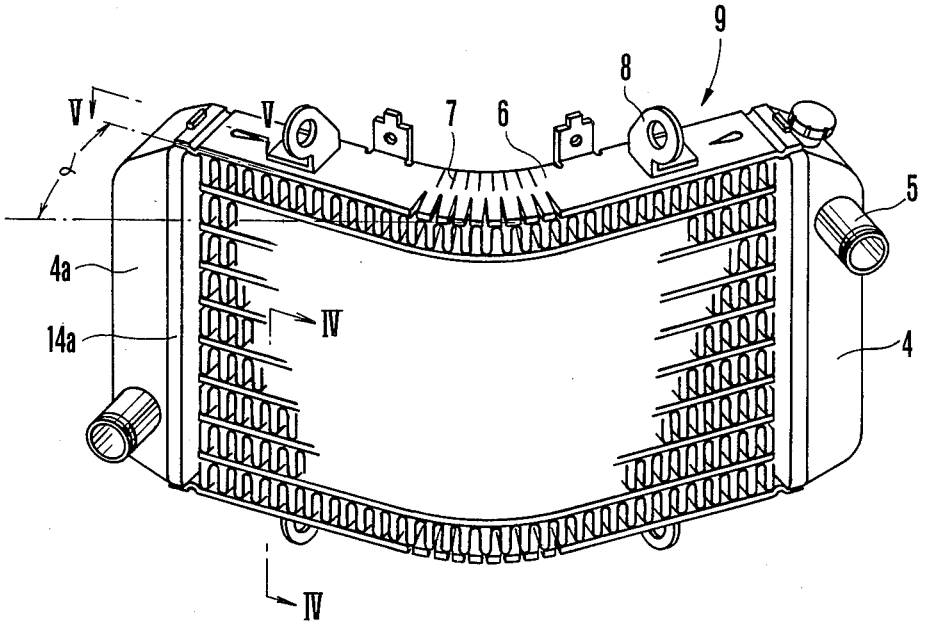
FIG. 3 is a perspective view of a completed product or embodiment of the radiator of the present invention after the step of the bending operation shown in FIG. 2.

Namely, in the bending operation, as shown in FIG. 2, the straight radiator 9 constructed of the straight radiator core 1 and the reinforcing plates 6, 6a is horizontally mounted on a pair of supporting plates 13, 13a at its opposite end portions such that air-intake openings of the radiator 9 face toward the floor. The supporting plates 13 and 13a are swingably mounted on pivot pins 25, 25a which are mounted on supporting members 12 and 12a, respectively. Under such circumstances, a roughly drum-shaped plunger 15 is pressed against a central portion of the straight radiator 9 as shown in FIG. 2. The plunger 15 can be driven in a direction shown by an arrow in FIG. 2, under the influence of any suitable force, such as hydraulic force, oil pressure, electrical force and the like.

Depending on the material, thickness and configuration of the components of the radiator 9, the limit of the bending angle of the radiator 9 varies.

For example, as shown in FIG. 4, according to the present invention: a pair of the flattened tubes 2, 2a are sandwiched in parallel between each of pairs of the corrugated sheets 3; any of the components comprising the flattened tubes 2, 2a, corrugated sheets 3 and the reinforcing plates 6, 6a is made of aluminum; and the reinforcing plate 6, 6a has a thickness of 1.2 mm, the corrugated sheet 3 has a thickness of 0.12 mm, and the flattened tube 2, 2a has a oval-shaped cross section which is provided with a major axis having a length of 22 mm and a minor axis of a length of 2 mm. The flattened tube 2, 2a has a thickness of 0.3 mm and a length of about 200 mm. Under the above-mentioned conditions, the bending operation of the straight radiator 9 is conducted to produce an arc-shaped radiator 9 slopes of which have angles identical with the bending angle "α" ranging from 7 to 25°.

In another example of the bending operation, there is employed the straight radiator 9 in which: a pair of the flattened tubes 2, 2a are sandwiched in parallel between each of pairs of the corrugated sheets 3; any of the components comprising the flattened tubes 2, 2a, corrugated sheets 3 and the reinforcing plates 6, 6a is made of aluminum; and the reinforcing plate 6, 6a has a thickness of 1.2 mm, the corrugated sheet 3 has a thickness of 0.12 mm, and the flattened tube 2, 2a has an oval-shaped cross section which is provided with a major axis having a length of 13 mm and a minor axis having a length of 2.3 mm. The flattened tube 2, 2a has a thickness of 0.3 mm and a length of about 200 mm. Under such conditions, the bending operation of the straight radiator 9 is conducted to produce an arc-shaped radiator 9 slopes of which have angles identical with the bending angle "α" ranging from 20 to 25°.

FIG. 3 is a perspective view of the thus produced arc-shaped radiator 9 of the present invention.

Figure 6:
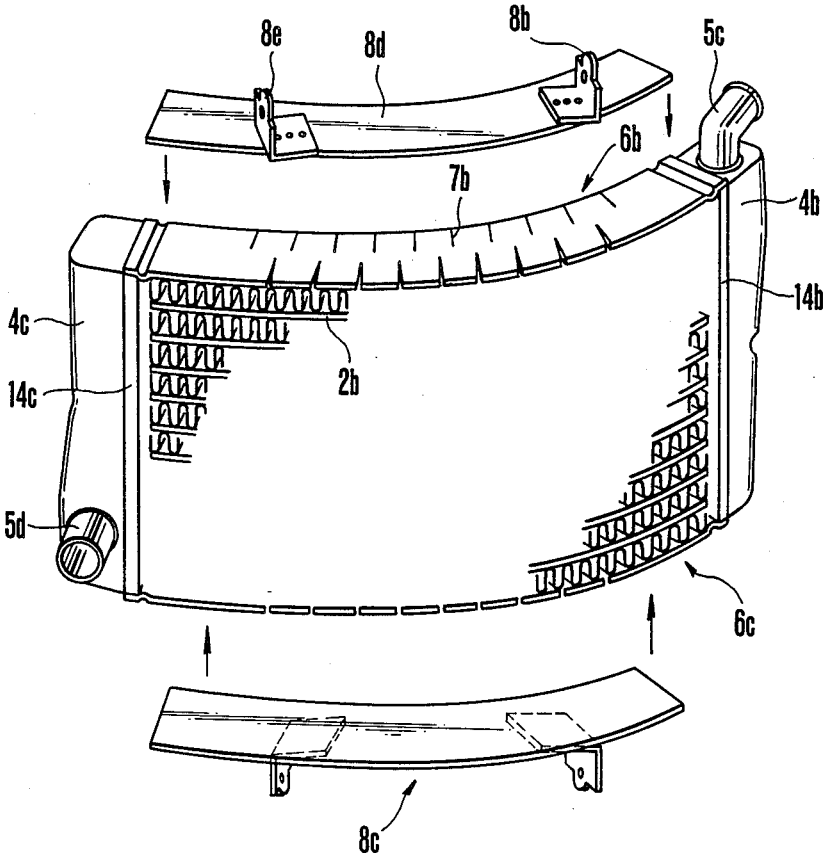
FIG. 6 is a perspective view of another embodiment of the radiator of the present invention, illustrating assembling steps of this embodiment of the present invention.

As shown in FIG. 6, in another embodiment of the present invention, other types of brackets 8b, 8e are fixed to arc-shaped supporting plates 8c, 8d in the vicinities of opposite ends of these plates 8c, 8d through suitable fastening means such as screws, swaging, welding and the like. Such arc-shaped supporting plates 8c, 8d serve as additional-reinforcing plates, and are fixed to the reinforcing plates 6b, 6c by TIG-arc welding and the like to cover the substantially entire surfaces of the reinforcing plates 6b, 6c of the arc-shaped radiator. However, the purpose of the additional-reinforcing plates 8c, 8d is to reinforce central slit portions of the reinforcing plates 6b, 6c, so that the additional-reinforcing plates 8c, 8d having an area covering such central slit portions only suffice to accomplish the above purpose.

In case that such arc-shaped additional-reinforcing plates 8c, 8d are employed in the arc-shaped radiator of the present invention as shown in FIG. 6, it is possible to further improve the radiator of the present invention in resistance to corrosive cracking, durability, damping properties and the like.

In the bending operation shown in FIG. 2, the water tanks 4, 4a of the straight radiator 9 are not subjected to the bending operation. Consequently, it is possible to conduct the bending operation with respect to the straight radiator 9 not provided with the water tanks 4, 4a. Namely, in this case, as shown in FIG. 1, the radiator core 1, headers 14 and 14a, and the reinforcing plates 6 and 6a are assembled and brazed to form a radiator assembly lacking the water tanks 4, 4a. Then, such radiator assembly is subjected to the bending operation so as to be shaped into an arc-shaped form. The thus arc-shaped radiator assembly and the water tanks 4, 4a are assembled and fixed to each other by suitable fastening means such as TIG-arc welding, brazing and the like to complete the arc-shaped radiator 9 of the present invention. In this case, since the water tanks 4, 4a are not provided in the radiator assembly being subjected to the bending operation, it is possible to arbitrarily select mounting angles of hose-connecting pipes 5, 5a of the water tanks 4, 4a, through which pipes 5, 5a the water tanks 4, 4a are connected to water hoses (not shown) for transferring the cooling water.

Figure 7:
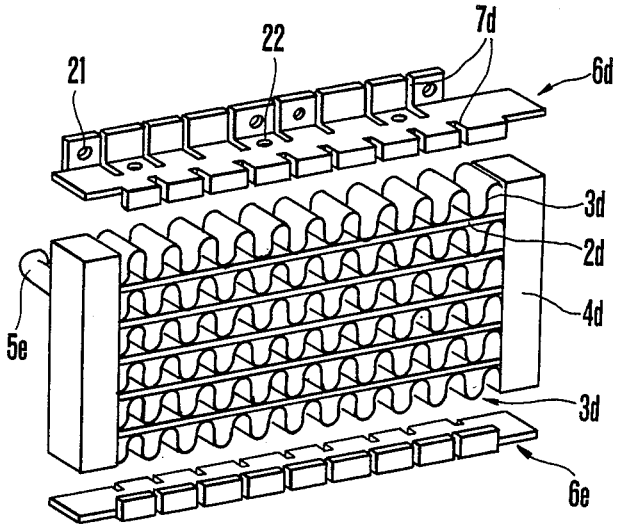
FIG. 7 is a perspective view of a further embodiment of the radiator of the present invention before its components are assembled according to the method of the present invention.

Another embodiment of the method of the present invention is shown in FIG. 7, which embodiment is different only in configurations of the reinforcing plates 6d, 6e from that shown in FIG. 1.

Figure 9:
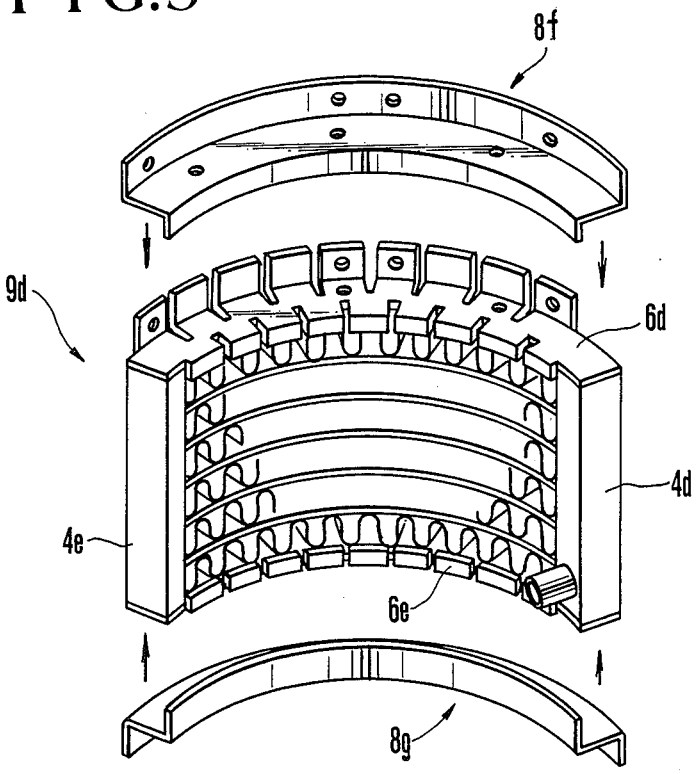
FIG. 9 is a perspective view of the embodiment of the present invention shown in FIG. 8, illustrating assembling step of the brackets with the radiator of the present invention shown in FIG. 8.

As shown in FIG. 7, opposite edge portions of each of the reinforcing plates 6d, 6e are bent at right angles in opposite directions to form vertical upward-extending rear and downward-extending front edge portions of the reinforcing plates 6d, 6e. As a result, slits 7d extend from horizontal portions of the reinforcing plates 6d, 6e to upper and lower ends of such vertical edge portions of the reinforcing plates 6d, 6e. These plates 6d, 6e are provided with holes 21 and pins 22 through which arc-shaped brackets 8f, 8g shown in FIG. 9 is mounted on the plates 6d, 6e, respectively.

Figure 8:
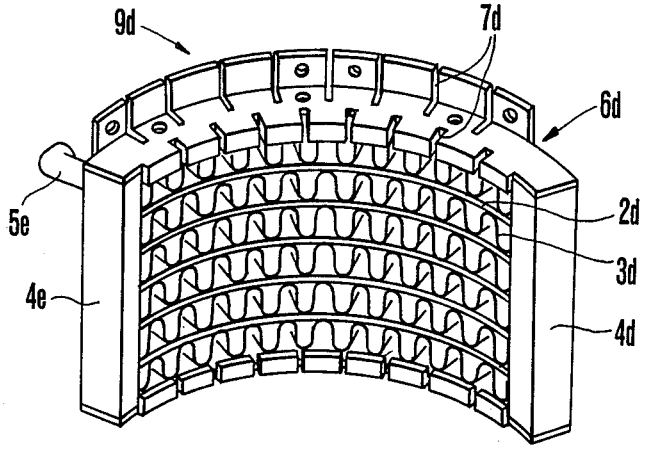
FIG. 8 is a perspective view of the embodiment of the radiator of the present invention shown in FIG. 7 after completion of assembling its components and bending of the thus assembled components of the radiator of the present invention.

The components of the straight radiator thus assembled and brazed according to the method of the present invention as shown in FIG. 7 is then subjected to the bending operation so as to be shaped into an A method of manufacturing a motorcycle radiator comprising the steps of:

(1) preparing, (a) a straight radiator core constructed of a plurality of corrugated sheets spaced alternately with a plurality of flattened tubes, said corrugated sheets constituting air fins for heat-exchange use, and said flattened tubes constituting water tubes through which cooling water passes, (b) a pair of elongated water tanks or headers having a plurality of holes and disposed in positions horizontally adjacent to opposite end openings of said flattened tubes so as to communicate with said flattened tubes through said holes and said openings, (c) a pair of metallic reinforcing plates having an elongated straight shape, between which said straight radiator core is sandwiched, each of said reinforcing plates being provided with a plurality of slits at its opposite longitudinal edge portions, each of said slits extending in a direction perpendicular to a longitudinal axis of each of said reinforcing plates;

(11) brazing, joints between said corrugated sheets and said flattened tubes, and joints between said corrugated sheets and said reinforcing plates, so that these components are fixedly assembled to form a straight radiator assembly whereby said opposite end openings of said flattened tubes join with said water tanks or headers in a watertight manner; and (111) bending said straight radiator assembly by a predetermined amount in a plane parallel to said longitudinal axis of said reinforcing plate into an arc-shaped form as shown in FIG. 8.

As shown in FIG. 9, the arc-shaped brackets 8*f*, 8*g* entirely cover the reinforcing plates 6*d*, 6*e* to which the brackets 8*f*, 8*g* are fixed, so that the arc-shaped and completed radiator is provided according to the present invention. The completed radiator is mounted on the motorcycle body through the brackets 8*f*, 8*g*. In this case, in addition to the brackets 8*f*, 8*g*, it is also possible to employ additional brackets mounted on the brackets 8*f*, 8*g*.

Such reinforcing plates 6*d*, 6*e* and the brackets 8*f*, 8*g* further improve the radiator of the present invention in its mechanical strength, durability and like properties.

Figure 10:
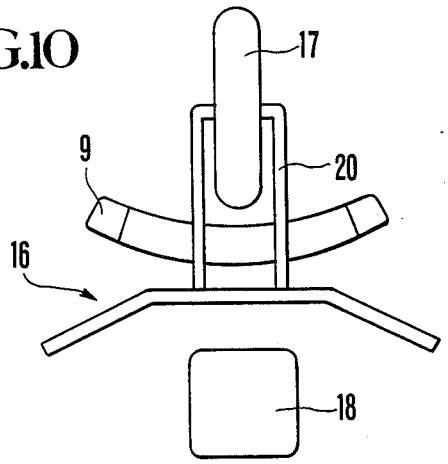
FIG. 10 is a schematic partial plan view of an example of the motorcycle on which the radiator of the present invention is mounted.

FIG. 10 is a schematic partial plan view of the motorcycle on a body of which is mounted the arc-shaped radiator 9 of the present invention. As shown in this drawing, a frame 20 rotatably supports a front wheel 17, and the radiator 9 is mounted on the motorcycle body, preferably, at a position between the front wheel 17 and an engine 18, through suitable brackets such as the brackets 8*f*, 8*g*.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of the present invention.

What is claimed is:

1. A method of manufacturing a motorcycle radiator comprising the steps of:

(i) preparing, (a) a straight radiator core constructed of a plurality of corrugated sheets spaced alternately with a plurality of flattened tubes, said corrugated sheets constituting air fins for heat-exchange use, and said flattened tubes constituting water tubes through which cooling water passes, (b) a pair of elongated water tanks having a plurality of holes and disposed in positions horizontally adjacent to opposite end openings of said flattened tubes so as to communicate with said flattened tubes through said holes and said openings, and (c) a pair of metallic reinforcing plates having an elongated straight shape, between which said straight radiator core is sandwiched, each of said reinforcing plates being provided with a plurality of slits formed at opposite longitudinal edge portions of each of said plates, each of said slits extending in a direction perpendicular to a longitudinal axis of each of said reinforcing plates, said slits on one of said opposite longitudinal edge portions being disposed in a row and at a predetermined pitch, and said slits on the other of said opposite longitudinal edge portions being disposed in another row and at said predetermined pitch at respective positions halfway between positions of adjacent ones of said slits on said one of said edge portions with respect to a direction parallel to said longitudinal axis;

(ii) brazing, joints between said corrugated sheets and said flattened tubes, and joints between said corrugated sheets and said reinforcing plates, so that these components are fixedly assembled to form a straight radiator assembly whereby said opposite end openings of said flattened tubes join with said water tanks in a watertight manner; and (iii) bending said straight radiator assembly by a predetermined amount in a plane parallel to said longitudinal axis of said reinforcing plates.

2. The method of manufacturing the motorcycle radiator as set forth in claim 1, wherein:

both of said flattened tube and said corrugated sheet are made of easily-bendable metal.

3. The method of manufacturing the motorcycle radiator as set forth in claim 2, wherein:

said easily-bendable metal is selected from the group consisting of copper, copper alloy, aluminum, aluminum alloy.

4. The method of manufacturing the motorcycle radiator as set forth in claim 1, wherein:

a single flattened tube is sandwiched between each of pairs of said corrugated sheets, while fixed to said corrugated sheets at its sides perpendicular to a minor axis of an oval-shaped cross section of said flattened tube.

5. The method of manufacturing the motorcycle radiator as set forth in claim 1, wherein:

a pair of said flattened tubes are sandwiched between each of pairs of said corrugated sheets, while fixed to said corrugated sheets at their sides perpendicular to minor axes of oval-shaped cross sections of said flattened tubes.

6. The method of manufacturing the motorcycle radiator as set forth in claim 1, wherein:

said reinforcing plate is constructed of a flat metallic plate.

7. The method of manufacturing the motorcycle radiator as set forth in claim 1, wherein:

said reinforcing plate is made of metal and is bent at its opposite edge portions in opposite directions so as to form an upward-extending front edge portion and a downward-extending rear edge portion thereof.

8. The method of manufacturing the motorcycle radiator as set forth in claim 1, wherein:

said reinforcing plate is provided with a bracket in its surface, through which bracket said radiator is mounted on a motorcycle body.

9. The method of manufacturing the motorcycle radiator as set forth in claim 8, wherein:

a pair of said brackets are fixed to said reinforcing plate in surfaces of its opposite end portions so as to be arranged along a longitudinal axis of said reinforcing plate.

10. The method of manufacturing the motorcycle radiator as set forth in claim 1, wherein:

said step of bending said straight radiator assembly by a predetermined amount in a plane parallel to said longitudinal axis of said reinforcing plate is conducted under the conditions that said straight radiator assembly is supported on a pair of supporting means at its opposite end portions while pressed downward at its central portion by a plunger, to give said straight radiator an arch-shaped form.

11. A method of manufacturing a motorcycle radiator comprising the steps of:

(i) preparing, (a) a straight radiator core constructed of a plurality of corrugated sheets spaced alternately with a plurality of flattened tubes, said corrugated sheets constituting air fins for heat-exchange use, and said flattened tubes constituting water tubes through which cooling water passes, (b) a pair of elongated headers having a plurality of holes and disposed in positions horizontally adjacent to opposite end openings of said flattened tubes so as to communicate with said flattened tubes through said holes and said openings, and (c) a pair of metallic reinforcing plates having an elongated straight shape, between which said straight radiator core is sandwiched, each of said reinforcing plates being provided with a plurality of slits formed at opposite longitudinal edge portions of each of said plates, each of said slits extending in a direction perpendicular to a longitudinal axis of each of said reinforcing plates, said slits on one of said opposite longitudinal edge portions being disposed in a row and at a predetermined pitch, and said slits on the other of said opposite longitudinal edge portions being disposed in another row and at said predetermined pitch at respective positions halfway between positions of adjacent ones of said slits on said one of said edge portions with respect to a direction parallel to said longitudinal axis;

(ii) brazing joints between said corrugated sheets and said flattened tubes, and joints between said corrugated sheets and said reinforcing plates, so that these components are fixedly assembled to form a straight radiator assembly whereby said opposite end openings of said flattened tubes join with said headers in a watertight manner;

(iii) bending said straight radiator assembly by a predetermined amount in a plane parallel to said longitudinal axis of said reinforcing plates; and (iv) each of said headers are connected with a water tank in a watertight manner so as to communicate therewith.

12. A motorcycle radiator comprising an arc-shaped radiator core produced according to the method defined in any one of claims 1 to 11.

* * * * *